US007556565B2

(12) United States Patent
Kim

(10) Patent No.: US 7,556,565 B2
(45) Date of Patent: Jul. 7, 2009

(54) GOLF BALL CONVEYING APPARATUS FOR USE ON DRIVING RANGES

(76) Inventor: Si-Myung Kim, A-301 Hyundai Hitz Villa, No. 106-34, Junggok-dong, Kwangjin-gu, Seoul (KR)

( * ) Notice: Subject to any disclaimer, the term of this patent is extended or adjusted under 35 U.S.C. 154(b) by 225 days.

(21) Appl. No.: 11/669,120

(22) Filed: Jan. 30, 2007

(65) Prior Publication Data

US 2007/0178984 A1 Aug. 2, 2007

(30) Foreign Application Priority Data

Feb. 1, 2006 (KR) ..... 10-2006-0009566

(51) Int. Cl.
*A63B 69/36* (2006.01)

(52) U.S. Cl. ..... 473/132; 473/136

(58) Field of Classification Search ..... 473/132, 473/134–136; 198/371.2, 461.3, 781.11
See application file for complete search history.

(56) References Cited

U.S. PATENT DOCUMENTS 2,670,835 A * 3/1954 Huttmann ..... 198/419.1
3,567,223 A * 3/1971 Gentiluomo ..... 473/135
3,599,980 A * 8/1971 Harmond et al. ..... 473/153
3,602,506 A * 8/1971 Gentiluomo ..... 473/132
3,706,452 A * 12/1972 Soucie ..... 473/166
3,797,827 A * 3/1974 Child ..... 473/166
4,126,313 A * 11/1978 Izumi ..... 473/136
5,901,833 A * 5/1999 Yokoyama ..... 198/725
5,901,854 A * 5/1999 Ishii ..... 198/411
6,287,212 B1 * 9/2001 Wetherell et al. ..... 473/163
7,198,573 B2 * 4/2007 Kim ..... 473/132

FOREIGN PATENT DOCUMENTS

KR 473656 3/2005

* cited by examiner

*Primary Examiner*—Steven Wong
(74) *Attorney, Agent, or Firm*—Egbert Law Offices PLLC

(57) ABSTRACT

A golf ball carrying apparatus is used to carry golf balls to swing compartments at a single-floor or multi-floor driving range. The golf ball carrying apparatus of the present invention includes a chain, connected between a drive unit provided with a motor and a driven unit spaced apart from the drive unit, so that the chain is reversibly rotated, and a guide rail, provided around the chain and having a shape with reduced width from top to bottom. A plurality of ball supply ports and holes is formed in the guide rail in a longitudinal direction. A first detecting sensor is provided on an end of the guide rail. The carrying apparatus further includes a connection guide, provided in each of tee-up devices, with a second detecting sensor provided at a predetermined position, and a pushing device, provided at a position corresponding to each of the connection guides.

2 Claims, 6 Drawing Sheets

GOLF BALL CONVEYING APPARATUS FOR USE ON DRIVING RANGES

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates generally to golf ball carrying apparatuses used at driving ranges and, more particularly, to a golf ball carrying apparatus which is used to carry golf balls, which have been moved to each floor by a ball carrying elevator, to swing compartments in a single-floor or multi-floor driving range in which the golf balls that have been struck by golfers are collected in a machine room.

2. Description of Related Art Including Information Disclosed Under 37 CFR 1.97 and 37 CFR 1.98

Generally, in a driving range, golf balls, which have been collected in a machine room, are distributed to floors by a conveyor. As shown in FIG. 1, the distributed golf balls are moved to swing compartments by a carrying means, which is provided in a ceiling or a floor of the driving range. Thereafter, each golf ball is set to a desired position by a tee-up device provided in each swing compartment.

A representative example of such a carrying means was proposed in Korean Patent Registration No. 473656, which was filed by the inventor of the present invention, and is entitled "APPARATUS FOR CARRYING GOLF BALL USED IN DRIVING RANGE".

In the carrying apparatus of No. 473656, a ball supply channel is divided into first, second and third channels, and possibly more. Inclined guide plates are provided in the respective channels, and belts, each of which is reciprocally moved by a motor, are provided above the respective guide plates, to carry golf balls through supply passages provided in the walls of the respective channels.

However, the conventional carrying apparatus has a problem in that there are spatial restrictions limiting the installation thereof with respect to driving ranges having various shapes.

For example, in the case where a driving range is constructed using glass or another transparent material for parts other than the floor of the driving range, the carrying apparatus must be embedded in the floor, because there is a problem in that the driving range has a poor appearance if the carrying apparatus is provided on the ceiling. In this case, it is not easy to maintain and repair the carrying apparatus. Also, to facilitate the work of maintaining or repairing the carrying apparatus, part of a mat (an artificial grass mat or the like) which corresponds to the carrying apparatus must be cut and removably installed. Therefore, there are problems in that this part of the mat may undesirably move, which worsens the external appearance of the driving range.

BRIEF SUMMARY OF THE INVENTION

Accordingly, the present invention has been made keeping in mind the above problems occurring in the prior art, and an object of the present invention is to provide a golf ball carrying apparatus which is used in a driving range to supply golf balls, which have been carried to floors using an elevator and to a swing compartment. The apparatus has a simple structure, such that the space required to carry the golf balls is minimized. Maintenance and repair work thereon can be easily conducted, so that it is not required to remove or removably install parts of a mat between the swing compartments when maintenance or repair work is desired. The driving range has a clean and superior external appearance, and repair and installation costs are reduced. Extra golf balls can always be provided to every swing compartment.

In order to accomplish the above object, the present invention provides a golf ball carrying apparatus used at a driving range. A chain is connected between a drive unit having a motor and a driven unit spaced apart from the drive unit by a predetermined distance, so that the chain is reversibly rotated. A guide rail is provided around the chain and having a shape reduced in width from a top thereof to a bottom thereof, so that golf balls are placed in and guided by the guide rail, with a plurality of ball supply ports and holes formed in the guide rail in a longitudinal direction, and a first detecting sensor provided on an end of the guide rail. A connection guide is coupled to an end of each of the ball supply ports to guide a golf ball, unloaded from the guide rail, to a carrying pipe, the connection guide being provided in each of a plurality of tee-up devices, with a second detecting sensor provided at a predetermined position in the connection guide. A pushing means is provided at a position corresponding to each of the connection guides, comprising a movable part to be retractably inserted into the associated hole of the guide rail.

BRIEF DESCRIPTION OF THE SEVERAL VIEWS OF THE DRAWINGS

The above and other objects, features and advantages of the present invention will be more clearly understood from the following detailed description taken in conjunction with the accompanying drawings.

DETAILED DESCRIPTION OF THE INVENTION

Hereinafter, a golf ball carrying apparatus used at a driving range according to a preferred embodiment of the present invention will be described in detail with reference to the attached drawings.

Figure 1:
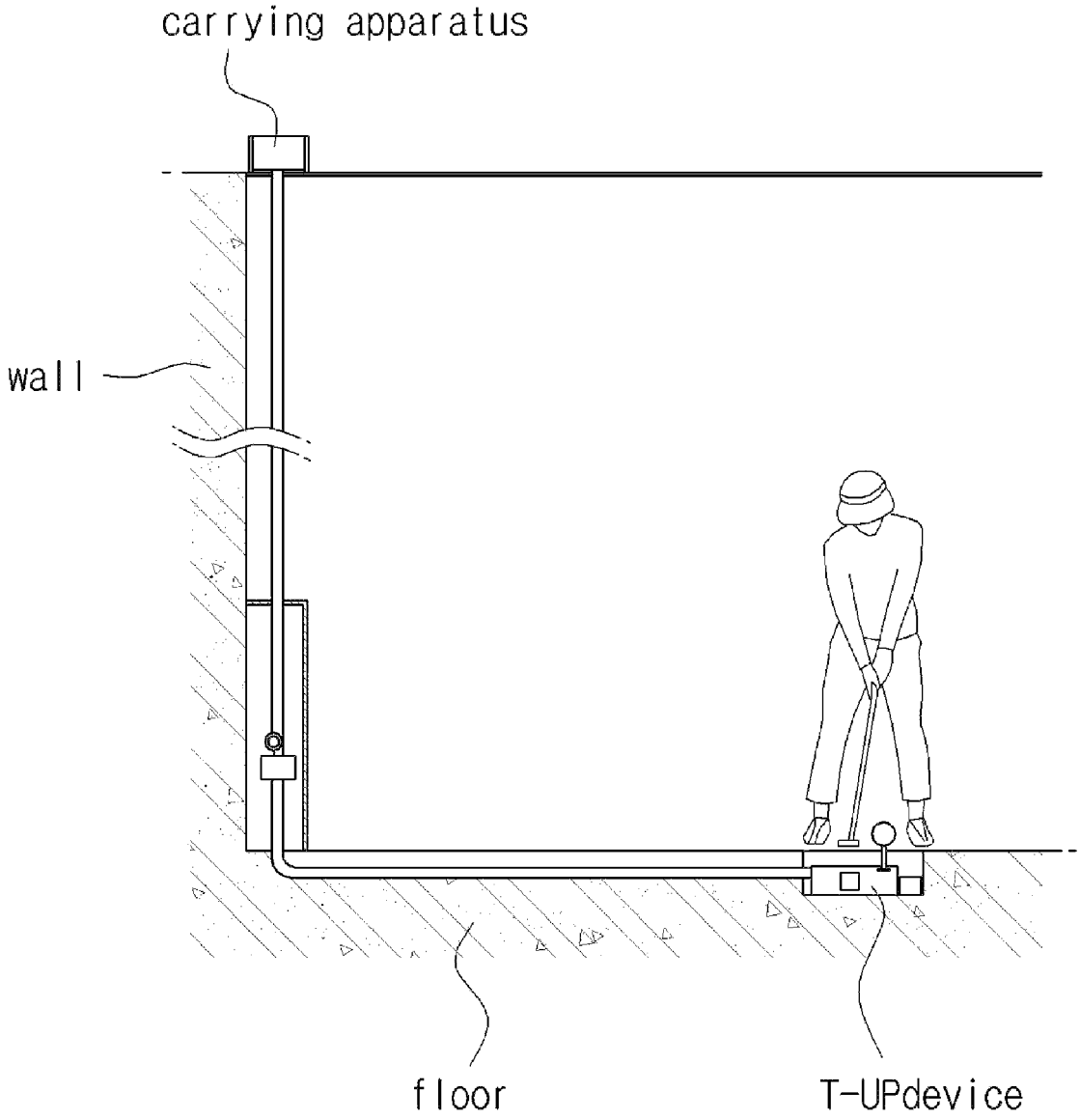
FIG. 1 is a schematic view showing a conventional golf ball carrying apparatus installed in an indoor driving range.
Figure 2:
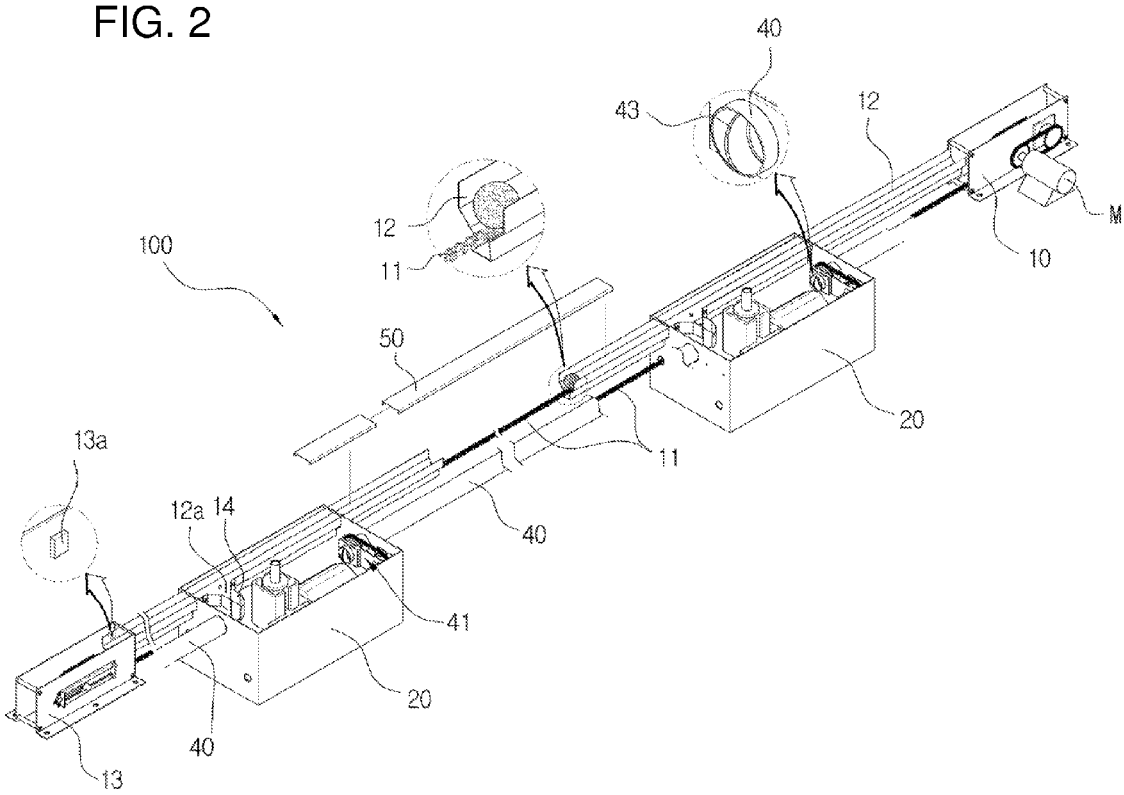
FIG. 2 is a perspective view showing a golf ball carrying apparatus used at a driving range, according to an embodiment of the present invention.
Figure 3:
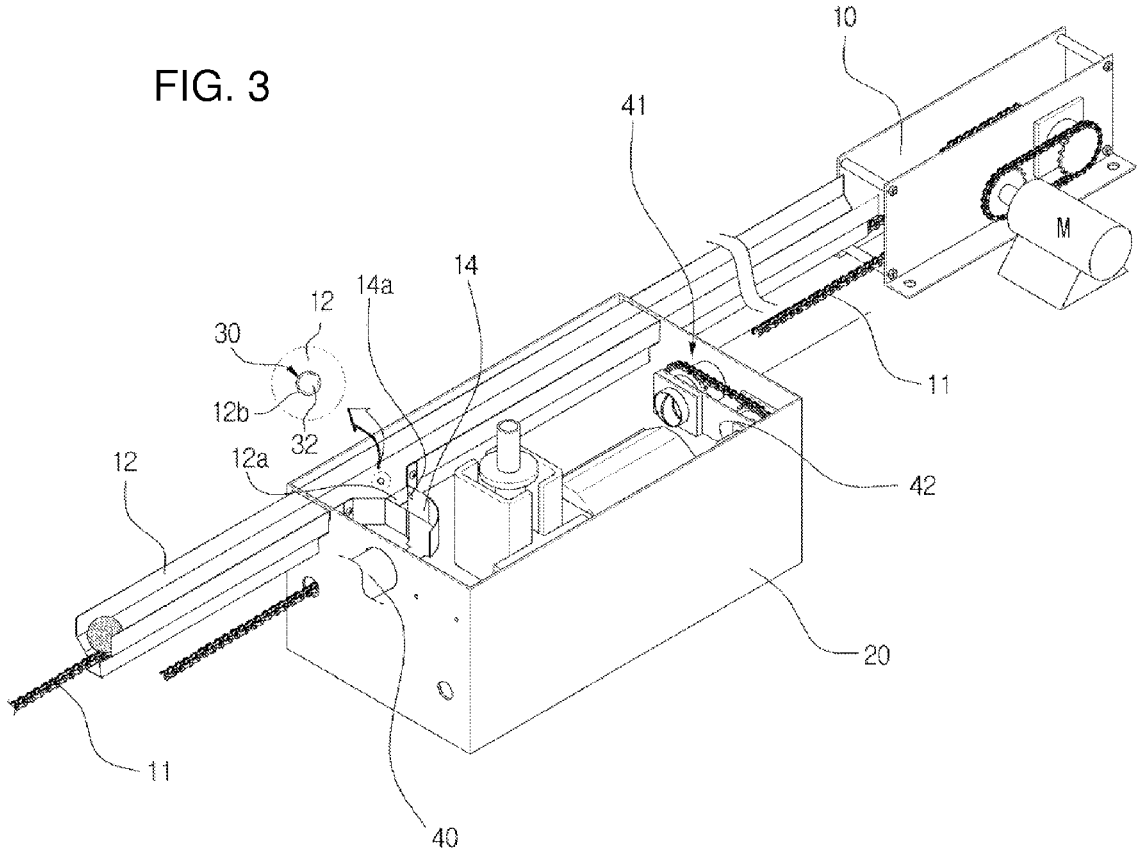
FIG. 3 is a perspective view showing a drive unit and a tee-up device for the golf ball carrying apparatus according to the present invention.
Figure 4:
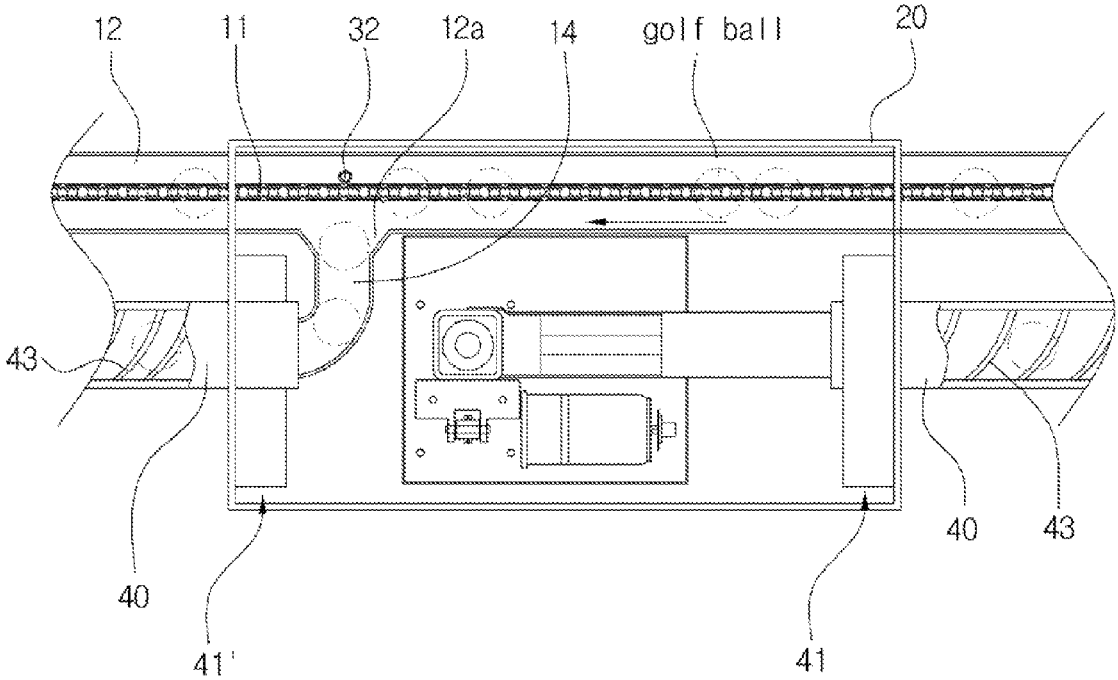
FIG. 4 is a plan view of the tee-up device of the golf ball carrying apparatus according to the present invention.

FIG. 2 is a perspective view showing the golf ball carrying apparatus 100 according to the preferred embodiment of the present invention. FIG. 3 is a perspective view showing a drive unit 10 and a tee-up device 20 of the golf ball carrying apparatus 100 of the present invention. FIG. 4 is a plan view of the tee-up device 20 of the golf ball carrying apparatus 100 of the present invention.

As shown in the drawings, in the golf ball carrying apparatus 100 used at the driving range (hereinafter, referred to simply as a carrying apparatus) according to the preferred embodiment of the present invention, golf balls, which have been carried by an elevator (not shown) to floors in the driving range, are supplied into drive units 10. Thereafter, the golf balls, which have been supplied into each drive unit 10, are supplied onto a guide rail 12, in which the chain 11 is installed, and are subsequently carried to the tee-up device 20, which is provided in each swing compartment.

Here, the chain 11 is installed in the corresponding floor and is reversibly rotated by the drive unit 10 and a driven unit 13, which are provided on opposite ends of the chain 11.

Furthermore, the chain 11 is provided in the guide rail 12, which has a shape such that it is reduced in width from the top thereof to the bottom thereof. Ball supply ports 12*a* are formed in the guide rail 12 at predetermined positions spaced apart from each other in a longitudinal direction. Furthermore, a hole 12*b*, through which a part of a golf ball pushing means 30 is exposed, is formed in the guide rail 12 at a position corresponding to each ball supply port 12*a*. A detecting sensor 13*a* is provided on an end of the guide rail 12.

In addition, one end of a connection guide 14 is coupled to the outer end of each ball supply port 12*a* to guide golf balls entering the ball supply port 12*a* into the associated tee-up device 20.

The connection guide 14 is bent in a U shape and serves to supply golf balls, which are supplied thereto, to a carrying pipe 40 without allowing golf balls to escape from the connection guide 14.

The golf ball pushing means 30 is attached to a coupling plate 31, which is coupled to the guide rail 12, and is operated by a sensor 14*a*, which is provided in the connection guide 14. The golf ball pushing means 30 includes a pushing rod 32, part of which is inserted into the guide rail 12 when the golf ball pushing means 30 is operated.

Meanwhile, the golf balls, which have been supplied into the connection guides 14, are supplied into the carrying pipes 40, which are connected to the respective tee-up devices 20, and are thereafter stored in the carrying pipes 40 and carried to the tee-up devices 20.

Furthermore, opposite ends of each carrying pipe 40 are coupled to respective support members 41 and 41'. The support members 41 and 41' are installed in the associated tee-up devices 20.

The end of the carrying pipe 40 which is supported by the support member 41 is coupled to and rotated by a motor 42, which is provided at a predetermined position on the support member 41, through a chain. In addition, a spiral protrusion 43 is provided on the inner surface of the carrying pipe 40. Thus, the carrying pipe 40 moves the golf balls, which have been supplied from the connection guide 14, to the associated tee-up device 20.

The tee-up device 20 serves to move a supplied golf ball upwards to a desired position at which a golfer strikes the golf ball. This is a well known technique, therefore further explanation is deemed unnecessary.

In the drawings, the reference numeral 50 denotes a cover for the guide rail 12.

The operation of the carrying apparatus 100 according to the embodiment of the present invention having the above-mentioned construction will be explained in detail with reference to FIGS. 5*a* and 5*b*.

Figure 5A:
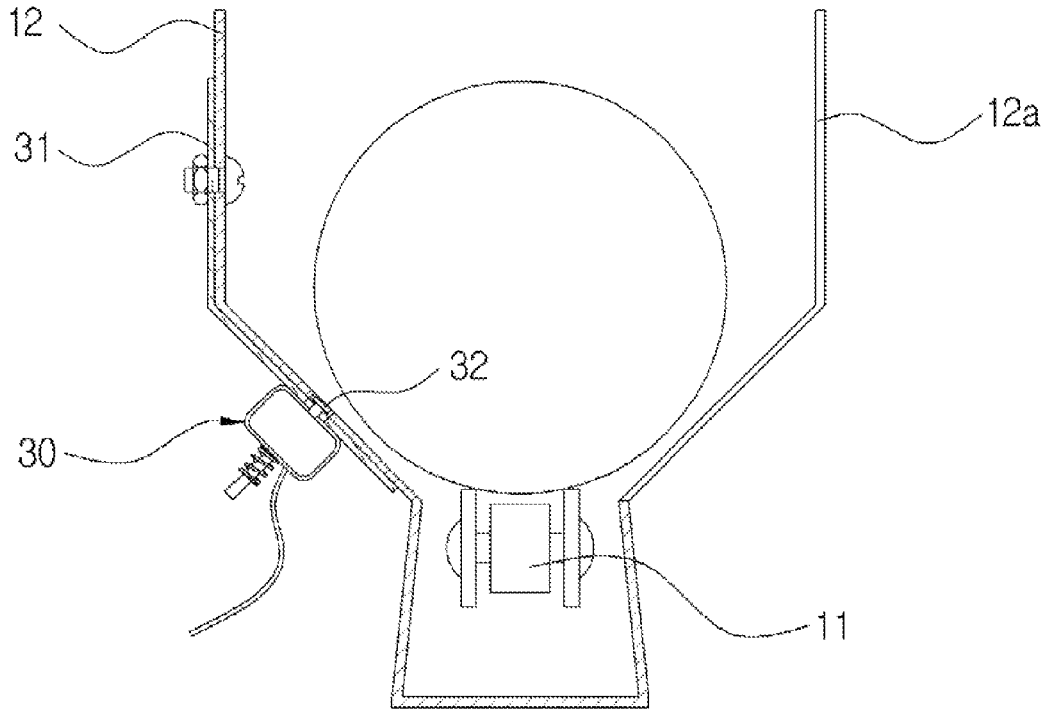
FIG. 5*a* is a front cross-sectional view showing a process of carrying a golf ball using a chain of the golf ball carrying apparatus according to the present invention.
Figure 5B:
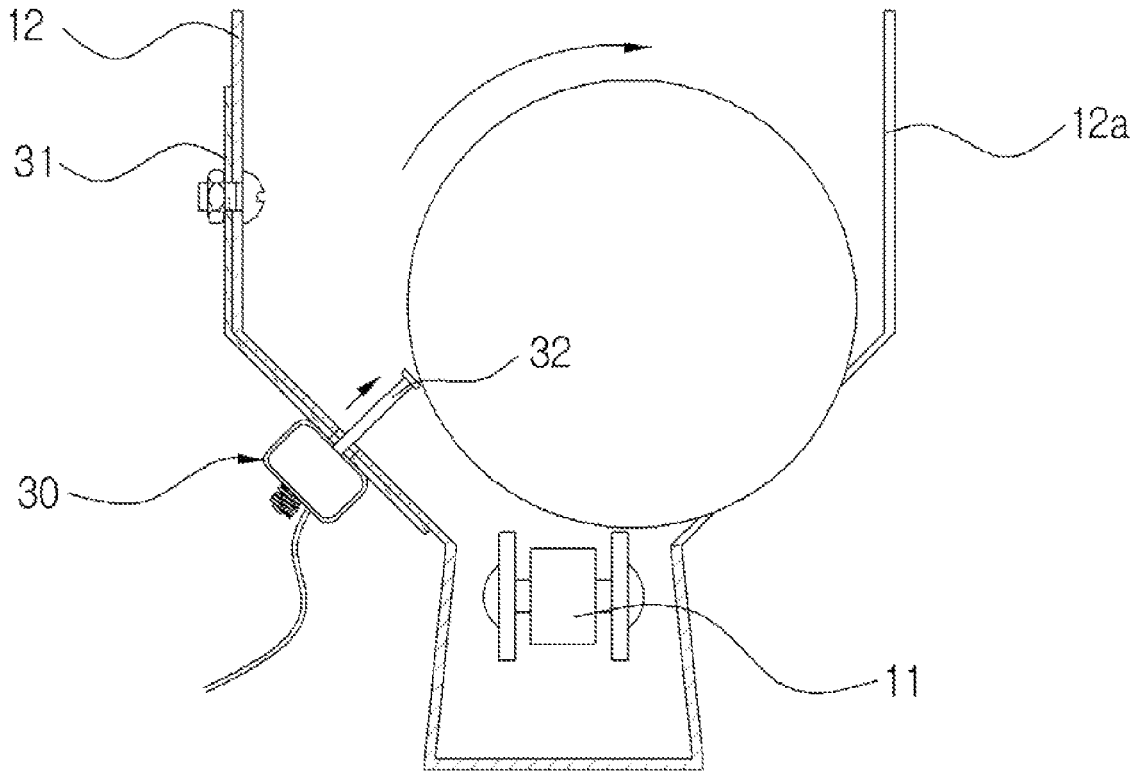
FIG. 5*b* is a front cross-sectional view showing a process of removing the golf ball from the chain of the golf ball carrying apparatus according to the present invention.

FIG. 5*a* is a front cross-sectional view showing a process of carrying a golf ball using the chain 11 of the carrying apparatus 100. FIG. 5*b* is a front cross-sectional view showing a process of removing the golf ball from the chain 11 of the carrying apparatus 100.

Golf balls are carried from an underground machine room to the floors by the elevator. Thereafter, the golf balls are supplied into the drive unit 10 of the carrying apparatus and seated on the chain 11, which is provided in the carrying apparatus, in a line.

The golf balls, which have been seated on the chain 11, are moved under the guidance of the guide rail 12 in a line. When the leading golf ball reaches the connection guide 14, the sensor 14*a* detects whether a golf ball is present in the connection guide 14. If no golf ball is present in the connection guide 14, power is automatically applied to the golf ball pushing means 30 to protrude the pushing rod 32, so that the direction in which the golf ball is moved is changed. Thus, the golf ball is removed from the guide rail 12 and supplied into the connection guide 14 through the ball supply port 12*a*. Thereafter, the golf ball is supplied from the connection guide 14 into the carrying pipe 40.

At this time, the motor 42, which is provided in the support member 41, is operated to rotate the carrying pipe 40, thus moving the supplied golf ball to the associated tee-up device 20.

The above process is conducted in the tee-up device 20 provided in every swing compartment. Here, extra golf balls are preferably prepared in the carrying pipe 40 as well as in the tee-up device 20. Remaining golf balls are continuously moved along the guide rail 12. When the leading golf ball of the remaining golf balls is sensed by the detecting sensor 13*a* of the driven unit 13, a drive motor M of the drive unit 10 is reversely rotated, so that the remaining golf balls, which are in the guide rail 12, are moved to the drive unit 10 and are discharged into the machine room.

As such, after the remaining golf balls have been carried into the machine room, golf balls are again carried to the floors through the elevator and are supplied to each swing compartment according to the number of golf balls used. Thereafter, remaining golf balls are moved to the machine room. This process is repeatedly conducted such that golf balls can always be ready in the swing compartments.

As described above, in the present invention, a golf ball carrying apparatus is installed in the floor of a driving range rather than being provided on the ceiling or some other place, so that it does not restrict the design of the driving range. Furthermore, unlike the conventional art, in which a portion of a mat is cut and removably installed to make it possible to repair the carrying apparatus between the swing compartments and to remove stuck golf balls, in the present invention, because processes of removing stuck golf balls and of repairing the carrying apparatus can be conducted without requiring removal of the mat, the mat can be integrally provided on the floor as a single body. Therefore, there is an advantage in that the clear and superior appearance of the driving range is ensured.

Although the preferred embodiment of the present invention has been disclosed for illustrative purposes, those skilled in the art will appreciate that various modifications, additions and substitutions are possible, without departing from the scope and spirit of the invention as disclosed in the accompanying claims.

I claim:

1. A golf ball carrying apparatus for use on driving ranges comprising:

a chain connected between a drive unit having a motor and a driven unit spaced apart from the drive unit by a predetermined distance, said motor being connected to said drive unit so as to reversibly drive said chain;

a guide rail extending around said chain, said guide rail having a top having a width greater than a width of a bottom thereof, said guide rail having a size suitable for receiving the golf ball and for allowing the golf ball to be guided therealong, said guide rail having a plurality of ball supply ports formed in longitudinally spaced relation;

a first detecting sensor means affixed at an end of said guide rail for detecting a presence of the golf ball in said guide rail so as to reverse said motor for moving the golf ball toward said drive unit;

a connection guide coupled to an end of each of said plurality of ball supply ports;

a carrying pipe connected to said connection guide, said connection guide having a size for guiding the golf ball from said guide rail to said carrying pipe;

a plurality of tee-up devices respectively connected to each of the carrying pipes;

a second detecting sensor means positioned on said connection guide for determining a presence of the golf ball in said connection guide; and a pushing means affixed to said guide rail at a location corresponding to said connection guide, said pushing means having a movable part retractably inserted through a hole of said guide rail, said pushing means for urging said movable part outwardly so as to urge the golf ball from said chain and into said connection guide.

2. The golf ball carrying apparatus of claim 1, said pushing means being attached to said guide rail by a coupling plate, said movable part being a push rod movable forwardly and backwardly relative to a detection by said second detecting sensor means.

* * * * *